US010066450B2

(12) United States Patent
Berner, Jr.

(10) Patent No.: US 10,066,450 B2
(45) Date of Patent: Sep. 4, 2018

(54) BENDING AND TORSIONAL STIFFENER FOR A RISER TENSIONER

(71) Applicant: The Technologies Alliance, Inc., Houston, TX (US)

(72) Inventor: Paul C. Berner, Jr., Houston, TX (US)

(73) Assignee: The Technologies Alliance, Inc., Houston, TX (US)

( * ) Notice: Subject to any disclaimer, the term of this patent is extended or adjusted under 35 U.S.C. 154(b) by 32 days.

(21) Appl. No.: 15/235,009

(22) Filed: Aug. 11, 2016

(65) Prior Publication Data

US 2017/0051564 A1 Feb. 23, 2017

Related U.S. Application Data

(60) Provisional application No. 62/207,204, filed on Aug. 19, 2015.

(51) Int. Cl.
*E21B 19/00* (2006.01)

(52) U.S. Cl.
CPC ..... *E21B 19/002* (2013.01)

(58) Field of Classification Search
CPC ..... E21B 19/006; E21B 19/004; E21B 17/01; E21B 17/046; E21B 17/017
USPC ..... 166/367
See application file for complete search history.

(56) References Cited

U.S. PATENT DOCUMENTS 4,298,221 A * 11/1981 McGugan ..... B23P 11/02 285/328
2007/0292214 A1* 12/2007 Godoy ..... E21B 17/017 405/224.2

* cited by examiner

*Primary Examiner* — Matthew R Buck
*Assistant Examiner* — Patrick F Lambe
(74) *Attorney, Agent, or Firm* — Baker Botts L.L.P.

(57) ABSTRACT

A stiffener assembly for a riser extending from a subsea well component through an opening in a floating platform has at least two partially cylindrical inner sleeve segments that mount around the riser. Inner sleeve grooves are on an outer surface of each of the inner sleeve segments, defining inner sleeve ribs. The inner sleeve segments have abutting side edges when mounted around the riser. At least two partially cylindrical outer sleeve segments are mounted around the inner sleeve segments. The outer sleeve segments have abutting side edges when mounted around the inner sleeve segments. Outer sleeve grooves on an inner surface of each of the outer sleeve segments define outer sleeve ribs that fit within the inner sleeve grooves between the inner sleeve ribs. The abutting side edges of the outer sleeve segments are circumferentially offset from the abutting side edges of the inner sleeve segments.

20 Claims, 5 Drawing Sheets

BENDING AND TORSIONAL STIFFENER FOR A RISER TENSIONER

1. CROSS-REFERENCE TO RELATED APPLICATION

This application claims priority to provisional application Ser. No. 62/207,204, filed Aug. 19, 2015.

2. FIELD OF THE DISCLOSURE

This disclosure relates in general to subsea well risers and in particular to a bending and torsional stiffener for an upper portion of the riser.

3. BACKGROUND

One type of offshore well equipment employs a floating platform, which may be used for drilling, production or both. One or more risers extend from wellhead equipment at the sea floor through openings in the platform. A riser tensioner applies tension to the riser. Wave and current can cause upward, downward and lateral movement of the platform relative to the riser.

The tensioner is made up multiple hydro-pneumatic cylinders spaced around the opening. If one of the cylinders fails, the upward forces exerted by the tensioner on the riser will no longer be balanced. The imbalance can cause bending of the upper portion of the riser, particularly where it passes through the opening. Even though a failed tensioner cylinder can usually be repaired without retrieving the riser, the bending may have damaged the riser. Retrieving a riser to replace a damaged upper portion of the riser may be very expensive.

4. SUMMARY

A stiffener assembly is disclosed for stiffening a riser extending from a subsea well component through an opening in a floating platform. The stiffener assembly includes an inner sleeve having a longitudinal axis and being split along inner sleeve split lines extending from an upper end to a lower end of the inner sleeve. The inner sleeve split lines define at least two inner sleeve segments to enable the inner sleeve to be mounted around the riser. A plurality of circumferentially extending, axially spaced apart inner sleeve ribs are located on an outer surface of each of the inner sleeve segments. An outer sleeve is mounted around the inner sleeve. The outer sleeve is split along outer sleeve split lines extending from an upper end to a lower end of the outer sleeve. The outer sleeve split lines define at least two outer sleeve segments. A plurality of circumferentially extending, axially spaced apart outer sleeve ribs are located on an inner surface of each of the outer sleeve segments. The outer sleeve ribs protrude radially inward and locate between the inner sleeve ribs. The outer sleeve split lines are circumferentially offset from the inner sleeve split lines.

In the embodiment shown, the inner sleeve split lines and the outer sleeve split lines are parallel with the axis. The inner sleeve split lines define side edges of each of the inner sleeve segments that abut when mounted around the riser. The outer sleeve split lines define side edges of each of the outer sleeve segments that abut when mounted around the inner sleeve segments.

In one embodiment, a plurality of fastener holes extend through the outer sleeve segments from an outer surface of the outer sleeve segments to the inner surface of the outer sleeve segments. A plurality of threaded holes in the outer surface of the inner sleeve segments register with the fastener holes. Threaded fasteners extend through the fastener holes and into the threaded holes to secure the outer sleeve segments to the inner sleeve segments.

The inner sleeve segments may have an external flange on upper ends of the inner sleeve segments for securing the inner sleeve segments to a connector on the riser. The inner sleeve ribs may extend from one of the inner sleeve split lines to the other of the inner sleeve split lines.

The outer sleeve ribs are equally spaced apart from each other and may be located throughout the inner surface of each of the outer sleeve segments from an upper end to a lower end of each of the outer sleeve segments. Each of the inner sleeve ribs may have a cylindrical crest. The outer sleeve ribs fit within spaces between each of the inner sleeve ribs. The outer sleeve ribs have flanks that engage flanks of the inner sleeve ribs.

5. BRIEF DESCRIPTION OF THE DRAWINGS

Figure 1:
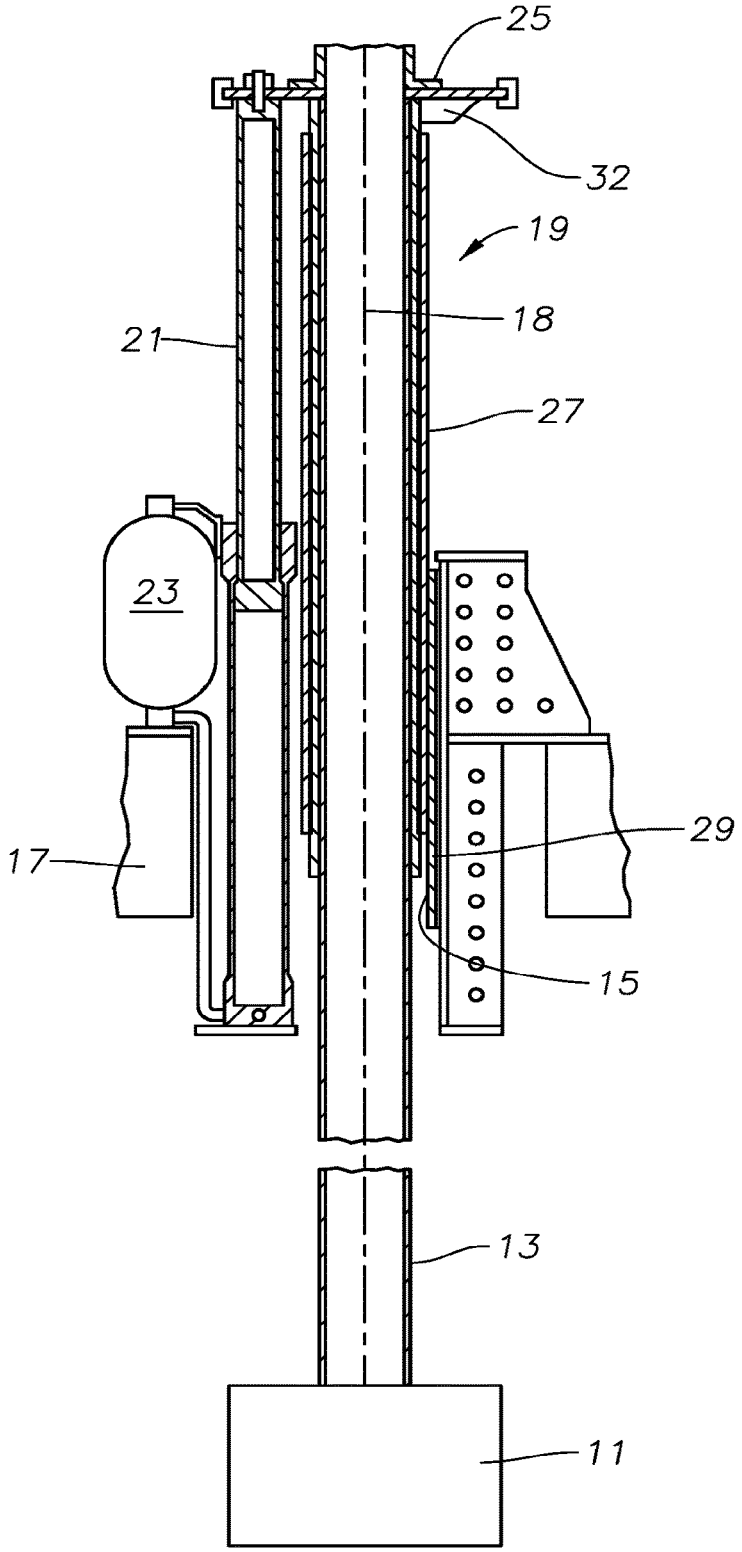
FIG. 1 is a sectional side view of a riser tensioner assembly in accordance with this disclosure, showing the tensioner in a top of the stroke position.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

6. DETAILED DESCRIPTION OF THE DISCLOSURE

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

A subsea wellhead or production unit 11 is schematically illustrated on a sea floor. Production unit 11 may be a production tree or some other type of equipment, such as a manifold, for conveying well fluid. A riser 13 extends upward from production unit 11. Riser 13 may be a variety of types, such as a production riser, an injection riser, or a drilling riser. Riser 13 is made up a number of sections of pipe with ends secured to each other. Riser 13 extends upward through an opening 15 of a floating production or drilling platform 17. The upper end of riser 13 extends through opening 15 along an axis 18 of opening 15.

A tensioner 19 mounts on the deck of platform 17 for exerting an upward force on riser 13 to apply tension. Tensioner 19 may be a variety of types. In this example, tension 19 includes a number of pressurized hydro-pneumatic fluid cylinders or rams 21 (only one shown) spaced around opening 15. A source 23 of pressurized fluid maintains fluid pressure in fluid cylinders 21. The upper ends of fluid cylinders 21 are coupled to riser 13, such as by a riser connector 25. As platform 17 moves relative to riser 13 due to wave motion and currents, fluid cylinders 21 will stroke between a top of the stroke position shown in FIG. 1 and a bottom of the stroke position shown in FIG. 2.

In the event one of the fluid cylinders 21 fails, the upward forces exerted on riser 13 would be unequal. A failure in one or more of the fluid cylinders 21 applies an additional amount of bending and torsional forces to the upper portion of riser 13. In this disclosure, a stiffener 27 mounts around the upper portion of riser 13 to assist riser 13 in resisting bending and torsion. Stiffener 27 locates within a bearing member or guide pipe 29 extending around opening 15. Platform 17 and bearing member 29 are movable in unison in up and down directions relative to stiffener 27. Stiffener 27 has a length not much greater than a length of the stroke of tensioner 19. For example, the length of stiffener 27 may be about 10 feet for a stroke of about 7 feet. In the bottom of the stroke position of FIG. 2, the upper end of stiffener 27 is only slightly above the upper end of opening bearing member 29. In the top of the stroke position of FIG. 1, the lower end of stiffener 27 may be recessed a short distance into bearing member 29.

Figure 2:
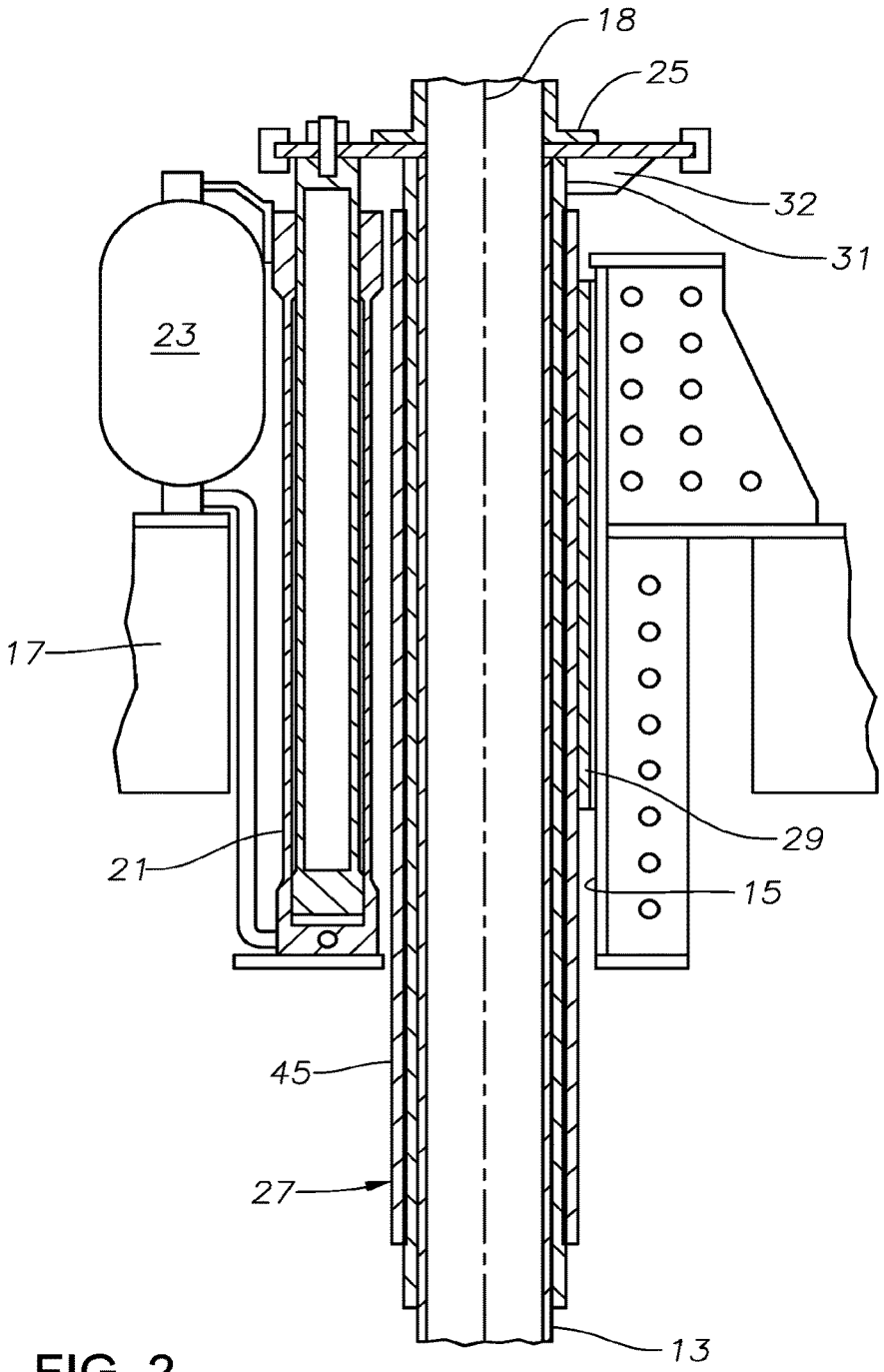
FIG. 2 is a sectional view of the tensioner assembly of FIG. 1, showing the tensioner in a bottom of the stroke position.
Figure 3:
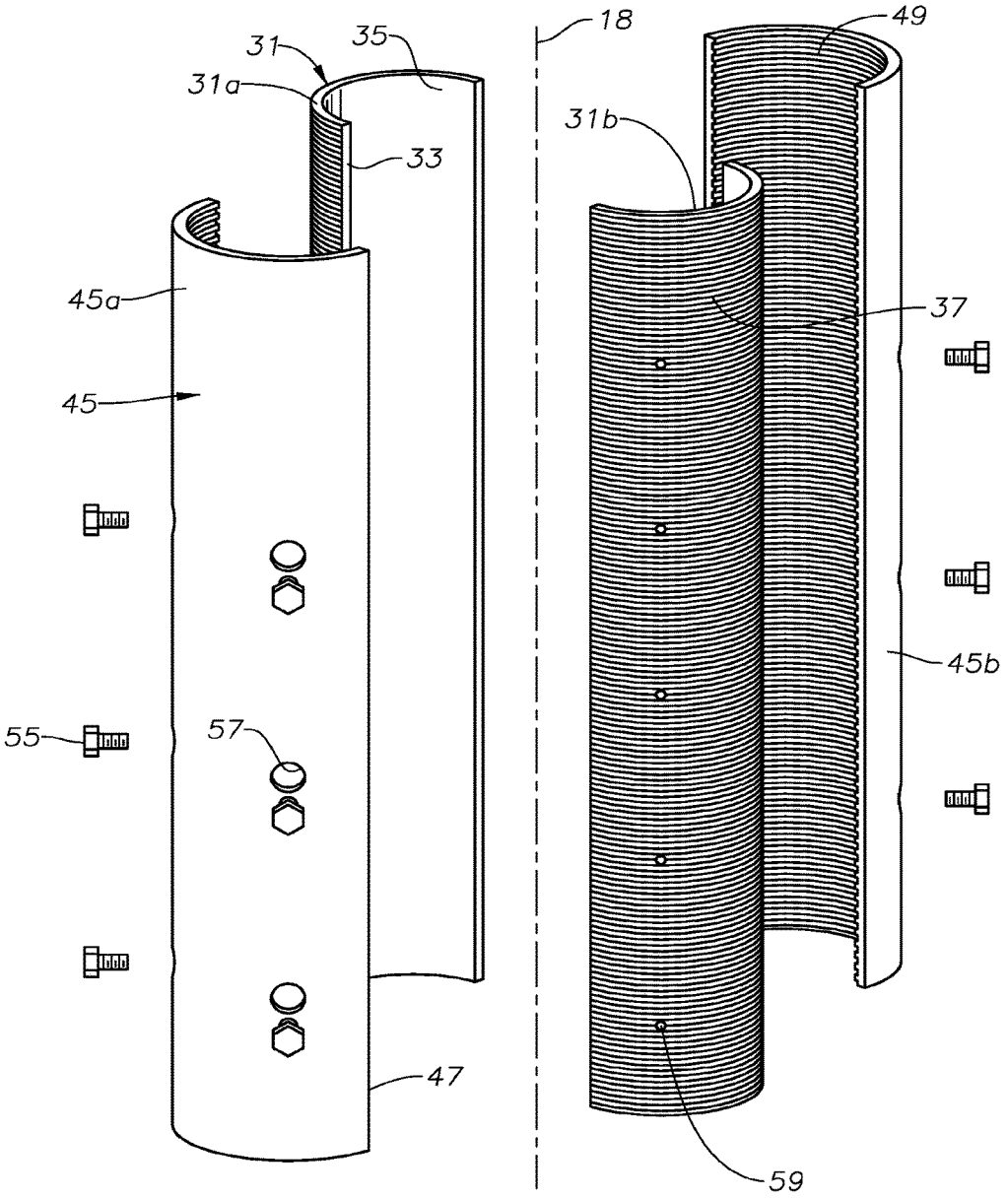
FIG. 3 is a perspective view of the stiffener of the tensioner assembly of FIG. 1, showing the inner and outer split sleeves exploded.
Figure 4:
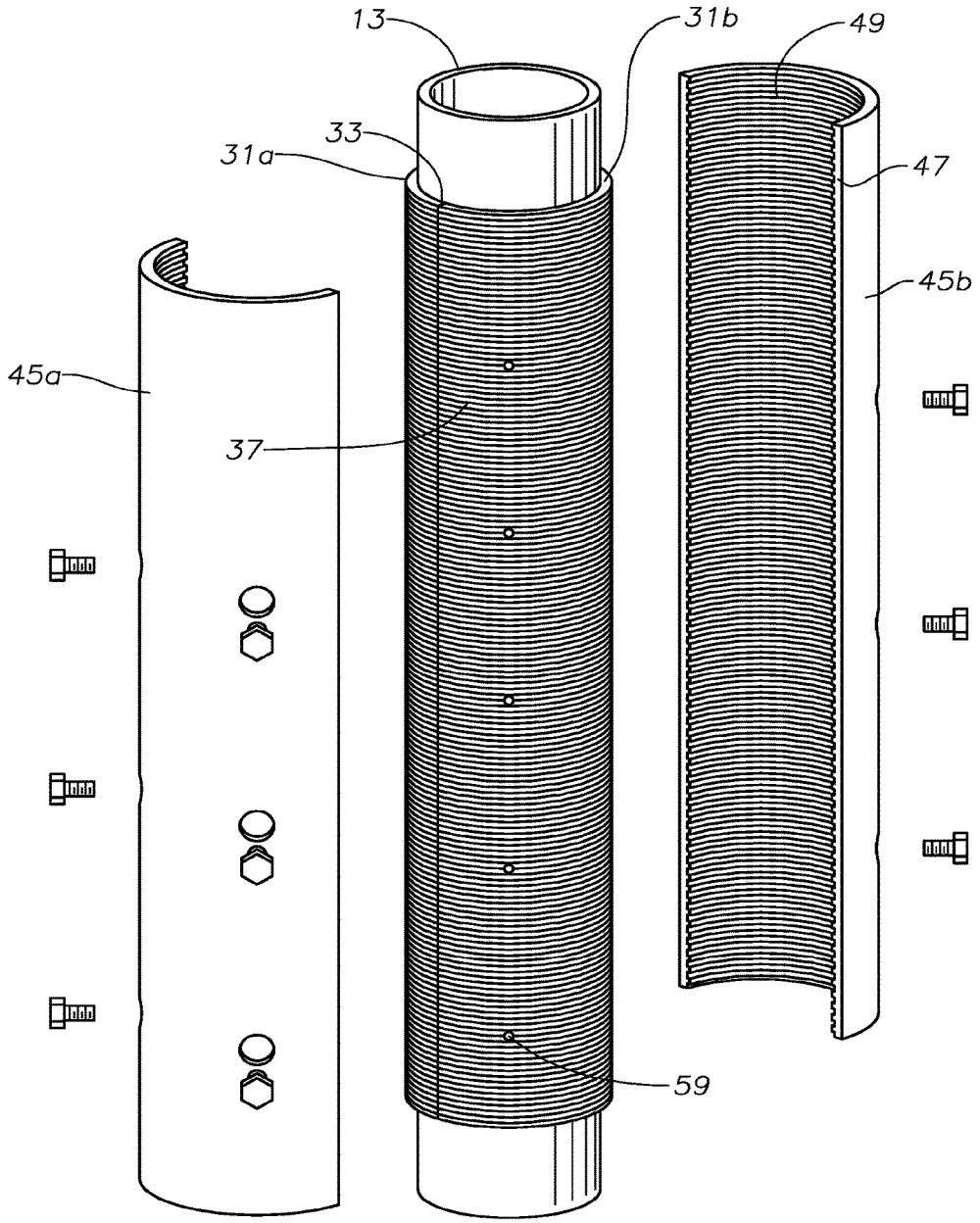
FIG. 4 is a perspective view of the stiffener of the tensioner assembly of FIG. 1, showing the inner split sleeve around the riser and the outer split sleeve exploded.

Instances exist in which an operator wishes to enhance the bending and torsional forces of an existing riser 13 without disconnecting riser 13 from subsea production unit 11 and pulling it to the surface. Riser 13 can be thousands of feet in length. As shown in FIGS. 3 and 4, stiffener 17 may be mounted around the upper portion of riser 13 without retrieving riser 13 to the surface. Stiffener 27 includes an inner sleeve or shell 31 that is split into two or more partially cylindrical segments 31*a*, 31*b*. Flanges 32 (FIGS. 1 and 2) on the upper ends of shell segments 31*a*, 31*b* bolt to riser connector 25. Flanges 32 are not shown in FIGS. 3-5. In this example, each segment 31*a*, 31*b* is one-half of a cylinder and identical to each other. Segments 31*a*. 31*b* are formed by two longitudinally extending cuts or split lines 33, each parallel with axis 18. Each segment 31*a*, 31*b* has a cylindrical inner surface 35 that may be smooth and which fits around the outer cylindrical surface of riser 13 (FIG. 1). Inner surface 35 optionally could be in contact with riser 13 or it spaced radially outward from riser 13. When mounted around riser 13, the side edges of segments 31*a*, 31*b* created by split lines 33 abut each other, as shown in FIG. 4.

Each segment 31*a*, 31*b* has an outer surface containing a plurality of circumferentially extending bands or ribs 37. Ribs 37 may be formed along the full length of each segment 31*a*, 31*b*, and be located on the entire outer surface of each segment 31*a*, 31*b*. Alternately, fewer ribs 37 could be employed, such as one or more at the upper end, one or more adjacent the lower end of each segment 31*a*, 31*b* and perhaps some in the middle. Each rib 37 extends circumferentially from one split line 33 to the other.

Figure 6:
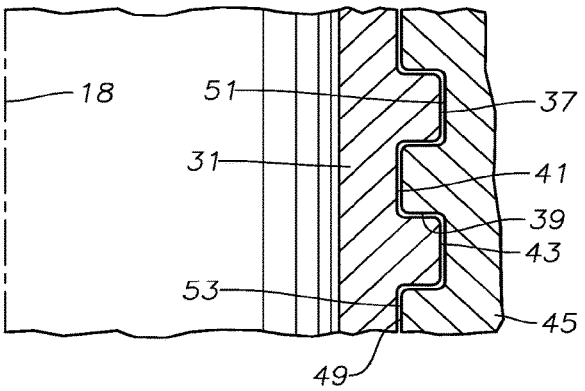
FIG. 6 is an axial sectional view of part of the grooves of one of the inner split sleeves in mating engagement with grooves of one of the outer split sleeves of the stiffener.

Referring to FIG. 6, ribs 37 may have the shape of a semi-square thread profile. Each rib 37 may have a lead or pitch, such as a thread form, in which case each rib 37 extends along a helical line around axis 18. Alternately, ribs 37 may be located in planes perpendicular to axis 18 and separated from the ribs 37 above and below. Each rib 37 has upper and lower flanks 39 that are preferably at a 80 to 90 degree angle relative to axis 18. If at 90 degrees, flanks 39 would be perpendicular to axis 18. A cylindrical groove 41 axially separates each rib 37 from the next one above and the next one below. If ribs 37 are in a helical thread form, grooves 41 may be considered to be roots of the threads. Each rib 37 has a cylindrical crest 43 at the outer ends of flanks 39. Bevels may be formed at the junctions of flanks 39 with crest 37. Crests 37 and grooves 41 have the same axial dimensions or heights. The axial dimension of each crest 37 and each groove 41 may differ from the radial protrusion of each flank 39 from groove 41 to crest 37. In this example, the radial dimension of each rib 37 is less than the axial dimension of each groove 41.

Referring again to FIGS. 3 and 4, stiffener 27 also includes an outer sleeve or shell 45, which mounts to and around inner shell 31. Outer shell 45 is divided into a plurality of segments, which in this example comprise two segments 45*a*, 45*b*. Two longitudinally extending cuts or split lines 47 extend the length of outer shell 45 parallel to axis 18. In this example, split lines 47 are 180 degrees apart from each other, resulting in each segment 45*a*, 45*b* being a half cylinder. When mounted around inner shell 31, the side edges of segments 45*a*, 45*b* created by split lines 47 abut each other.

Outer shell 45 has a plurality of ribs 49 on its inner surface, each extending circumferentially from one of the split lines 47 to the other. The outer surface of outer shell 45 may be smooth and cylindrical. Ribs 49 are configured the same as inner shell ribs 37 for mating engagement. As shown in FIG. 6, each outer shell rib 49 is separated from the nearest rib 49 above and below by a cylindrical groove 51. Each outer rib 49 has a cylindrical crest 53. The flanks of each rib 49 are preferably 90 degrees relative to crest 53 and groove 51. When outer shell 45 is mounted around inner shell 37, each outer shell rib 49 fits within one of inner shell grooves 41 with each outer shell crest 49 substantially touching each inner shell groove 41. Each outer shell groove 51 receives one of the inner shell ribs 37, with the inner shell crest 43 substantially touching the outer shell groove 51. The flanks of outer shell ribs 49 may be in contact with flanks 39 of inner shell ribs 37.

Figure 7:
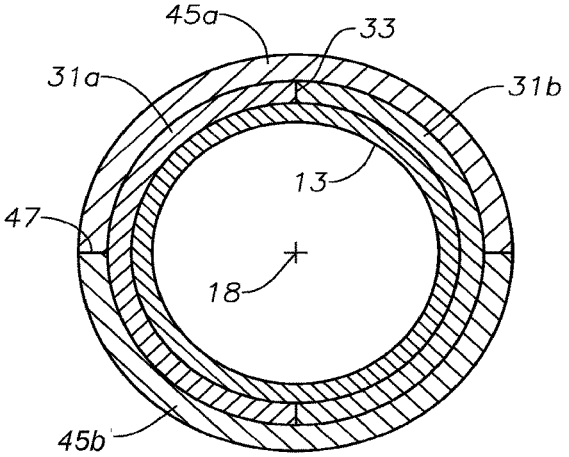
FIG. 7 is a sectional view of the stiffener mounted around the riser, taken along the line 7-7 of FIG. 5.

As illustrated in FIGS. 4 and 7, outer shell split lines 47 are circumferentially offset from inner shell splint lines 33. In the example shown, each outer shell split line 47 is circumferentially equidistant, or 90 degrees, from adjacent inner shell split lines 33. In other words, if inner shell split lines 33 are at twelve o'clock and six o'clock positions, outer shell split lines 47 will be at three o'clock and nine o'clock positions.

Figure 5:
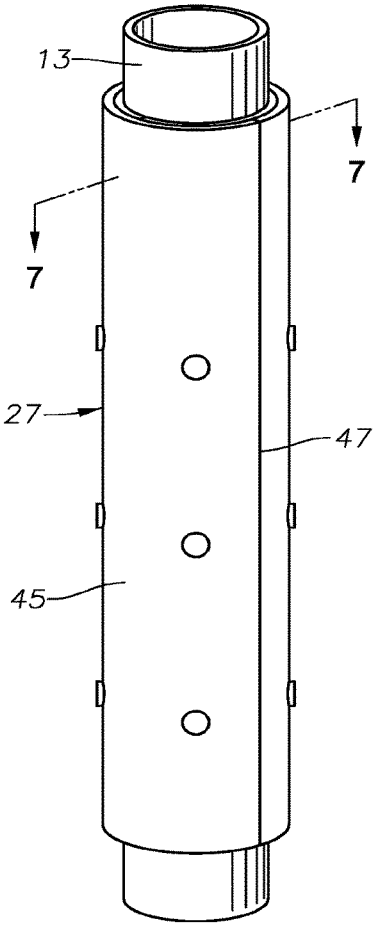
FIG. 5 is a perspective view of the stiffener of the tensioner assembly of FIG. 1, showing the inner and outer split sleeves secured to the riser.

Preferably, after mounting to riser 13, the abutting inner shell split lines 33 are not welded to each other. Also, preferably, the abutting outer shell split lines 47 are not welded to each other. Various means may be employed to fasten outer shell 45 to inner shell 31. In this example, fasteners or bolts 55 are employed, as shown in FIGS. 3-5. Bolts 55 pass through holes 57 in outer shell segments 45*a*, 45*b*, and secure in mating threaded holes 59 in inner shell segments 31*a*, 31*b*.

During operation stiffener 27 increases the stiffness of the portion of riser 13 that passes through opening 15 by increasing the moment of inertia in this portion. When subjected to bending or torsion, split lines 33, 47 cannot slip relative to each other because of the engagement of the profiles of ribs 37, 49.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

The invention claimed is:

1. A stiffener assembly for stiffening a riser extending from a subsea well component through an opening in a floating platform and coupled to the floating platform via a tensioner, the stiffener assembly comprising:

a cylindrical inner sleeve having a longitudinal axis and being split along inner sleeve split lines extending from an upper end to a lower end of the inner sleeve, the inner sleeve split lines defining at least two inner sleeve segments to enable the inner sleeve to be mounted around the riser, wherein a total axial length of the inner sleeve is greater than a stroke length of the tensioner;

a plurality of circumferentially extending, axially spaced apart inner sleeve ribs on an outer surface of each of the inner sleeve segments;

a cylindrical outer sleeve mounted around the inner sleeve, the outer sleeve being split along outer sleeve split lines extending from an upper end to a lower end of the outer sleeve, the outer sleeve split lines defining at least two outer sleeve segments, wherein a total axial length of the outer sleeve is greater than the stroke length of the tensioner;

a plurality of circumferentially extending, axially spaced apart outer sleeve ribs on an inner surface of each of the outer sleeve segments, the outer sleeve ribs protruding radially inward and mating with the inner sleeve ribs; and wherein the outer sleeve split lines are circumferentially offset from the inner sleeve split lines.

2. The assembly according to claim 1, wherein the inner sleeve split lines and the outer sleeve split lines are parallel with the axis.

3. The assembly according to claim 1, wherein:

the inner sleeve split lines define side edges of each of the inner sleeve segments that abut when mounted around the riser; and the outer sleeve split lines define side edges of each of the outer sleeve segments that abut when mounted around the inner sleeve segments.

4. The assembly according to claim 1, further comprising:

a plurality of fastener holes extending through the outer sleeve segments from an outer surface of the outer sleeve segments to the inner surface of the outer sleeve segments;

a plurality of threaded holes in the outer surface of the inner sleeve segments that register with the fastener holes; and threaded fasteners extending through the fastener holes and into the threaded holes to secure the outer sleeve segments to the inner sleeve segments.

5. The assembly according to claim 1, further comprising:

an external flange on upper ends of the inner sleeve segments for securing the inner sleeve segments to a connector on the riser.

6. The assembly according to claim 1, wherein:

the inner sleeve ribs extend from one of the inner sleeve split lines to the other of the inner sleeve split lines.

7. The assembly according to claim 1, wherein:

the outer sleeve ribs are equally spaced apart from each other and located throughout the inner surface of each of the outer sleeve segments from an upper end to a lower end of each of the outer sleeve segments.

8. The assembly according to claim 1, wherein:

each of the inner sleeve ribs has a cylindrical crest.

9. The assembly according to claim 1, wherein:

the outer sleeve ribs fit within spaces between each of the inner sleeve ribs, and the outer sleeve ribs have flanks that engage flanks of the inner sleeve ribs.

10. A stiffener assembly for a riser extending from a subsea well component through an opening in a floating platform and coupled to the floating platform via a tensioner, the stiffener assembly comprising:

at least two partially cylindrical inner sleeve segments for mounting around the riser, wherein a total axial length of each of the inner sleeve segments is greater than a stroke length of the tensioner;

a plurality of circumferentially extending, axially spaced apart inner sleeve grooves on an outer surface of each of the inner sleeve segments, defining inner sleeve ribs, the inner sleeve grooves having cylindrical bases, the inner sleeve ribs having upper and lower flanks protruding outward from the inner sleeve grooves, each of the inner sleeve ribs having a cylindrical crest;

the inner sleeve segments having abutting side edges when mounted around the riser;

at least two partially cylindrical outer sleeve segments mounted around the inner sleeve segments, the outer sleeve segments having abutting side edges when mounted around the inner sleeve segments, wherein a total axial length of each of the outer sleeve segments is greater than the stroke length of the tensioner;

a plurality of circumferentially extending, axially spaced apart outer sleeve grooves on an inner surface of each of the outer sleeve segments, defining outer sleeve ribs that matingly fit within the inner sleeve grooves between the inner sleeve ribs; and wherein the abutting side edges of the outer sleeve segments are circumferentially offset from the abutting side edges of the inner sleeve segments.

11. The assembly according to claim 10, wherein:

each of the inner sleeve segments extends 180 degrees; and each of the outer sleeve segments extends 180 degrees.

12. The assembly according to claim 11, wherein:

the abutting side edges of the inner sleeve are 90 degrees circumferentially from the abutting side edges of outer sleeve.

13. The assembly according to claim 10, further comprising:

an external flange on an upper end of each of the inner sleeve segments for securing the inner sleeve segments to a connector on the riser.

14. The assembly according to claim 10, further comprising:

a plurality of fastener holes extending through each of the outer sleeve segments from an outer surface of each of the outer sleeve segments to the inner surface of each of the outer sleeve segments;

a plurality of threaded holes in the outer surface of each of the inner sleeve segments that register with the fastener holes; and threaded fasteners extending through the fastener holes and into the threaded holes to secure the outer sleeve segments to the inner sleeve segments.

15. A method for stiffening a riser extending from a subsea well component through an opening in a floating platform, the riser being supported in tension by a tensioner extending between the platform and a riser connector, the method comprising:

without disconnecting the tensioner from the riser, securing at least two partially cylindrical inner sleeve segments around a portion of the riser that passes through the opening, an outer surface of each of the inner sleeve segments having a plurality of circumferentially extending inner sleeve ribs, wherein a total axial length of each of the inner sleeve segments is greater than a stroke length of the tensioner; then securing at least two partially cylindrical outer sleeve segments around the inner sleeve segments, the outer sleeve segments having on an inner surface circumferentially extending outer sleeve ribs that fit between and engage the inner sleeve ribs, wherein a total axial length of the outer sleeve segments is greater than the stroke length of the tensioner.

16. The method according to claim 15, further comprising providing the inner sleeve segments and the outer sleeve segments with lengths greater than an axial length of the opening, relative to an axis of the opening.

17. The method according to claim 15, wherein securing the inner sleeve segments around the riser comprises providing each of the inner sleeve segments with external flanges, and securing the flanges to the riser connector.

18. The method according to claim 15, wherein:

each of the inner sleeve segments has two side edges extending from an upper end to a lower end of each of the inner sleeve segments;

each of the outer sleeve segments has two side edges extending from an upper end to a lower end of each of the outer sleeve segments;

securing the outer sleeve segments around the inner sleeve segments comprises circumferentially spacing the side edges of the outer sleeve segments apart from the side edges of the inner sleeve segments.

19. The method according to claim 15, wherein securing the outer sleeve segments around the inner sleeve segments comprises inserting threaded fasteners through holes in the outer sleeve segments into threaded holes in the inner sleeve segments.

20. The method according to claim 15, wherein the opening in the floating platform has a guide pipe through which the riser passes, the guide pipe being separate from the riser and coupled to the floating platform, and wherein:

securing the inner sleeve segments comprises placing upper ends of the inner sleeve segments above the guide pipe; and securing the outer sleeve segments comprises placing upper ends of the outer sleeve segments above the guide pipe.

* * * * *